US010703559B2

(12) United States Patent
Matos Rodriguez

(10) Patent No.: US 10,703,559 B2
(45) Date of Patent: Jul. 7, 2020

(54) CONTAINER FOR STRAWBERRIES

(71) Applicant: DOÑANA 1998, S.L., Almonte, Huelva (ES)

(72) Inventor: Manuel Matos Rodriguez, Huelva (ES)

(73) Assignee: SONANA 1998, S.L., Almonte, Huelva (ES)

( * ) Notice: Subject to any disclaimer, the term of this patent is extended or adjusted under 35 U.S.C. 154(b) by 373 days.

(21) Appl. No.: 15/409,154

(22) Filed: Jan. 18, 2017

(65) Prior Publication Data

US 2017/0210548 A1 Jul. 27, 2017

(30) Foreign Application Priority Data

Jan. 21, 2016 (EP) ..... 16382022

(51) Int. Cl.

| | |
|---|---|
| ***B65D 85/34*** | (2006.01) |
| ***B65D 81/133*** | (2006.01) |
| ***B65D 1/36*** | (2006.01) |
| ***B65D 25/10*** | (2006.01) |
| ***B65D 81/26*** | (2006.01) |

(52) U.S. Cl.

CPC ..... *B65D 85/34* (2013.01); *B65D 1/36* (2013.01); *B65D 25/10* (2013.01); *B65D 81/133* (2013.01); *B65D 81/261* (2013.01)

(58) Field of Classification Search

CPC ..... B65D 1/36; B65D 81/133; B65D 85/34; B65D 25/10; B65D 81/261

USPC ..... 206/557; D9/757–758, 645

See application file for complete search history.

(56) References Cited

U.S. PATENT DOCUMENTS 3,204,848 A * 9/1965 Olson ..... B65D 85/324 206/521.1
3,245,570 A * 4/1966 Friday ..... B65D 1/36 206/521.1
3,355,084 A * 11/1967 Donovan ..... B65D 85/34 229/120.07
3,451,577 A 6/1969 Nurick
3,853,221 A * 12/1974 Boyd ..... B65D 1/36 206/523
3,902,622 A * 9/1975 Emery ..... B65D 85/34 217/26.5

(Continued)

FOREIGN PATENT DOCUMENTS

EP 2915758 A1 9/2015

*Primary Examiner* — Ernesto A Grano
(74) *Attorney, Agent, or Firm* — Hayes Soloway PC

(57) ABSTRACT

A punnet for strawberries, configured by a sheet with a flat surface, from which a number of cavities extend inferiorly, to accommodate strawberries in a horizontal position, and superiorly a number of protuberances, located in correspondence with the cavities. The protuberances feature a hollow interior which defines a niche to accommodate strawberries in a vertical position. The geometry and dimensions of each of the cavities and the niches are determined by those of the strawberries to be accommodated therein. The sheet of the punnet further comprises a plurality of tear lines to enable its division into a plurality of punnets. The punnet thus defined therefore enables the accommodation of strawberries in a horizontal position in a first orientation and in a vertical position in a second orientation, opposite and alternative to the first.

6 Claims, 4 Drawing Sheets

(56) References Cited

U.S. PATENT DOCUMENTS

| | | | | | |
|---|---|---|---|---|---|
| 3,997,057 | A * | 12/1976 | Craig | B65D 5/509 | 206/507 |
| 4,101,049 | A * | 7/1978 | Wallace | B65D 21/045 | 206/507 |
| 4,195,743 | A * | 4/1980 | Emery | B65D 1/36 | 206/511 |
| 4,821,901 | A * | 4/1989 | Bixler | B65D 85/322 | 217/18 |
| 5,005,703 | A * | 4/1991 | Bodker | A01K 63/02 | 119/201 |
| 5,597,073 | A * | 1/1997 | Kocis | B65D 85/34 | 206/507 |
| 6,131,732 | A * | 10/2000 | Schneider | A47G 23/0641 | 206/217 |
| 6,767,608 | B1 * | 7/2004 | Salvaggio | B65D 1/36 | 206/564 |
| 8,778,430 | B2 * | 7/2014 | Dietrich | B65B 5/06 | 426/110 |
| D800,577 | S * | 10/2017 | Matos Rodriguez | D9/762 | |
| 2003/0121820 | A1 * | 7/2003 | Mostini | B65D 1/36 | 206/521.6 |
| 2004/0260587 | A1 * | 12/2004 | Vanduyne | B65D 71/70 | 705/26.41 |
| 2014/0367297 | A1 * | 12/2014 | Kelly | B65D 71/0096 | 206/509 |

* cited by examiner

CONTAINER FOR STRAWBERRIES

OBJECT OF THE INVENTION

The present invention pertains to the technical field of containers for the storage and transport of objects; more specifically to that of those especially adapted for fruits, and the object of which is a punnet-type container for the transport, preservation and display of strawberries.

BACKGROUND OF THE INVENTION

Various types of packaging for fruits are well-known in the current marketplace; in each case, the determining factors of the most suited for each case being the maintenance of the optimal physiological conditions of the product, extending its preservation, and the appropriate presentation to make it attractive to the consumer. It must be borne in mind at all times that the packaging factor must not significantly increase the final price of the product.

Among said packaging, various groups may be discerned, such as those for bulk transport and sale for example, which include the well-known corrugated cardboard or wooden boxes; those for retail sale, such as trays, bags and sacks, usually made of plastic material, and those destined for products requiring special preservation conditions, such as selectively permeable multilayer bags for vacuum packing and preservation at low temperatures.

Among said groups of packages, those most suited for high value added products, that is, those sought by gourmet-style consumers, are those for retail sale, such as trays of moulded pulp or polystyrene, plastic bags or mesh sacks.

This type of consumer appreciates more and more the correct presentation and quality of the final product, also existing a tendency to seek products whose handling, from their collection at source to their purchase by the end buyer at the sales outlet, has been kept to a minimum.

In accordance with the different types of market, it may be more convenient to show either a lateral view of the fruit, so as to view its shape and colour, or a top view, which reveals one of the extremities of the strawberry, enabling the purchaser to observe the state of preservation.

Current packages do not provide the possibility to show, in a single container and individually, the different units of the fruit in question in accordance with the different orientations preferred in the different types of market, nor do they enable the establishment and maintenance of appropriate conditions to guarantee optimal preservation.

DESCRIPTION OF THE INVENTION

The tray for containing strawberries of the present invention consists of a medium for storage and presentation, preferably destined to be fitted in box-like containers with dimensions standardised for their stacking on pallets, and enabling the storage, transport, preservation and display of strawberries, maintaining their optimal conditions, in a manner which is flexible, both regarding the positions for the presentation of the fruit and the dimensions of the same.

To this end, said tray is configured by a sheet with a flat surface, in which a plurality of cavities are formed, destined to accommodate the strawberries individually in a horizontal position, enabling the consumer to view the lateral surface of the fruit. The cavities feature a preferably alveolar shape, in correspondence with the habitual geometry of said strawberries, said cavities being uniformly distributed throughout the surface of the sheet in such a way that they are separated from one another and that there is no possibility of contact between strawberries arranged in neighbouring cavities.

Each of the alveolar cavities features a perforation executed at its base, to facilitate uniform refrigeration of the individual strawberries and to enable the drainage of fluids which might accumulate and damage the fruit. Said fluids originate principally from the ripening of the fruit, although they may also be derived from changes in temperature.

In correspondence with each of the cavities, a plurality of protuberances are superiorly extended regarding the flat surface; these protuberances being essentially of a truncated pyramidal shape with bevelled edges, rounded sides and a hollow interior; wherein one side acts as a support for the lower extremity of the strawberry accommodated in the corresponding first cavity, thus enabling the tray to be arranged in a slightly tilted manner at the sales outlet without the strawberries falling from their compartments. The hollow configuration and the geometry of each of said protuberances additionally form a number of niches within which the strawberries disposed in a vertical position may be accommodated, facilitating the viewing of the sepal.

It is further foreseen that the tray may feature a plurality of tear lines to enable its division, by means of simple manual traction, into a plurality of smaller-sized trays, thus facilitating transport and storage, and making it particularly versatile and adaptable in domestic environments.

It is also foreseen that the perimetral edge of the tray shall further comprise a reversible extension, configured, on the one hand, to facilitate the fitting of the tray in the box, and on the other, so that once removed from said box, it may act as a support, raising and separating it from the plane on which it is disposed.

The tray thus described is therefore able to accommodate strawberries disposed in a horizontal position on one of its sides, while on the opposite side the strawberries are placed in a vertical position. In addition to facilitating the transport and preservation of the strawberries when inserted into boxes, this tray enables their display at the sales outlet, even in a slightly tilted position, without there being any risk of the fruit contained therein falling, and likewise functioning as a means of storage in domestic environments.

DESCRIPTION OF THE DRAWINGS

As a supplement to the description made herein, and for the purpose of aiding the better understanding of the characteristics of the invention, in accordance with a preferred example of a practical embodiment of the same, wherein the tray comprises 16 compartments, a set of drawings is attached as an integral part of said description wherein, by way of illustration and not limitation, the following is portrayed.

PREFERRED EMBODIMENT OF THE INVENTION

With the aid of FIGS. 1 to 7 mentioned above, a detailed explanation of an example of a preferred embodiment of the object of the present invention, wherein the tray comprises 16 compartments, is provided below.

Figure 1:
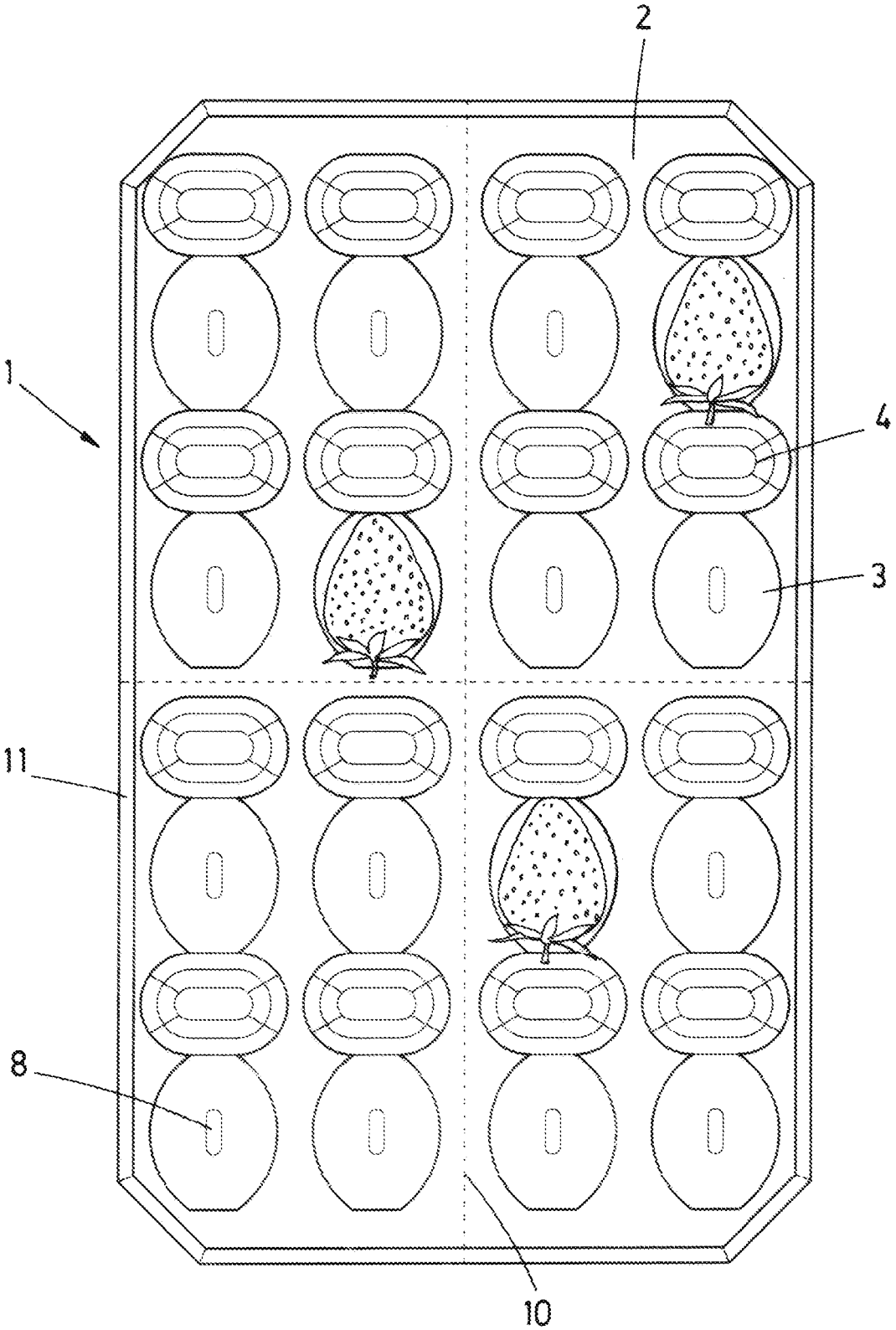
FIG. 1 portrays a plan view of the upper side of the tray, wherein the principal elements constituting the same may be viewed.

The punnet for strawberries, intended to be contained in box-like packages of standardised dimensions for their transport and storage on pallets, is comprised of a sheet (1) of an essentially rectangular shape, with bevelled corners, as portrayed in FIG. 1, said sheet (1) featuring a flat surface (2).

Figure 2:
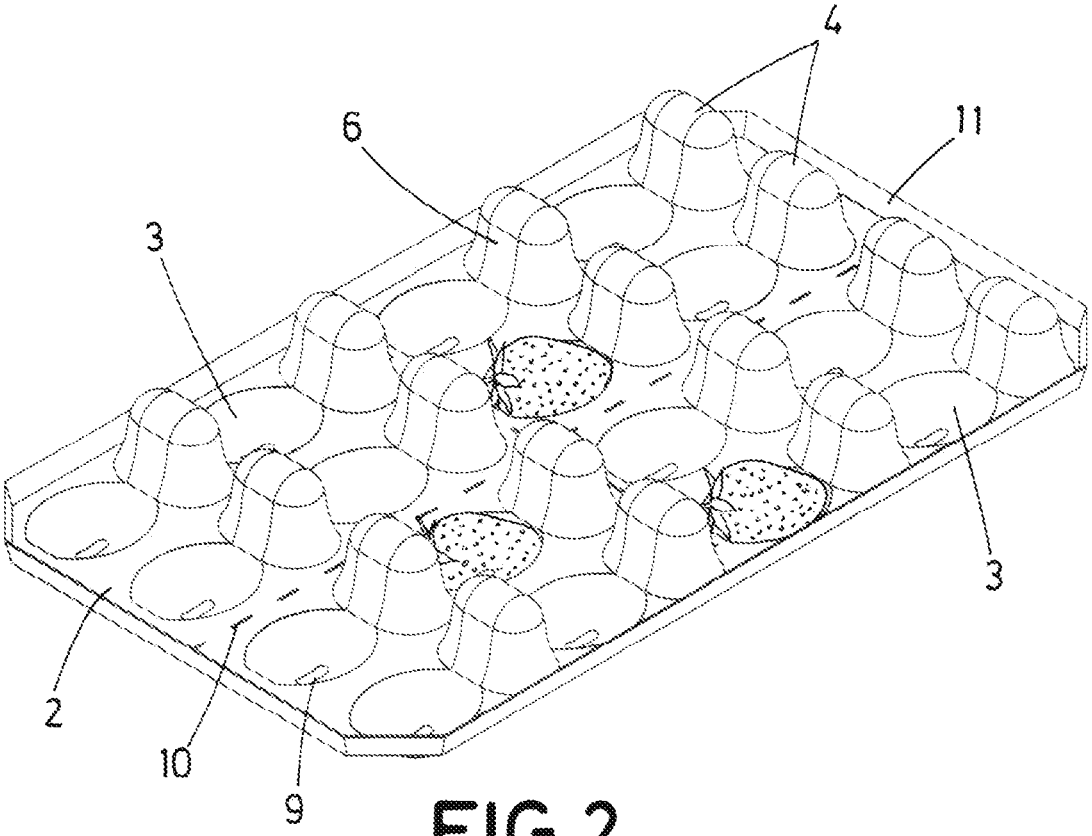
FIG. 2 portrays a perspective view of the upper side of the tray.
Figure 3:
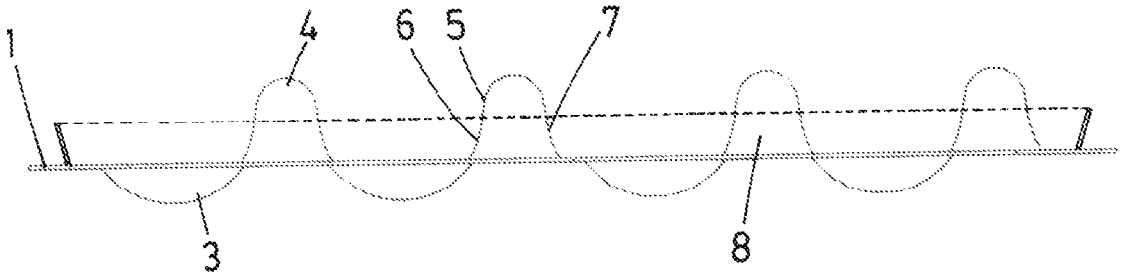
FIG. 3 portrays a lateral view of a longitudinal cross-section of the tray.

As may be seen in FIGS. 1, 2 and 3, from the flat surface (2) of the sheet (1), a plurality of cavities (3) extend inferiorly. Said cavities (3) present a curved configuration, delimited by an essentially elliptic perimetral edge, featuring a larger axis and a smaller axis, with two bevel edges, each of said bevel edges being defined at each of the extremities of the larger axis, thus endowing the cavities (3) with a three-dimensional geometry, essentially alveolar in shape, which enables the accommodation of the strawberries in a horizontal position, revealing their lateral surface.

From the flat surface (2) of the sheet (1), a number of protuberances (4) extend superiorly, located in correspondence with one of the bevel edges of each of the cavities (3). As is portrayed in FIG. 3, the protuberances (4) incorporate an outstanding sector (5), featuring an external side (6) and an internal side (7), defining and delimiting a niche (8).

Figure 4:
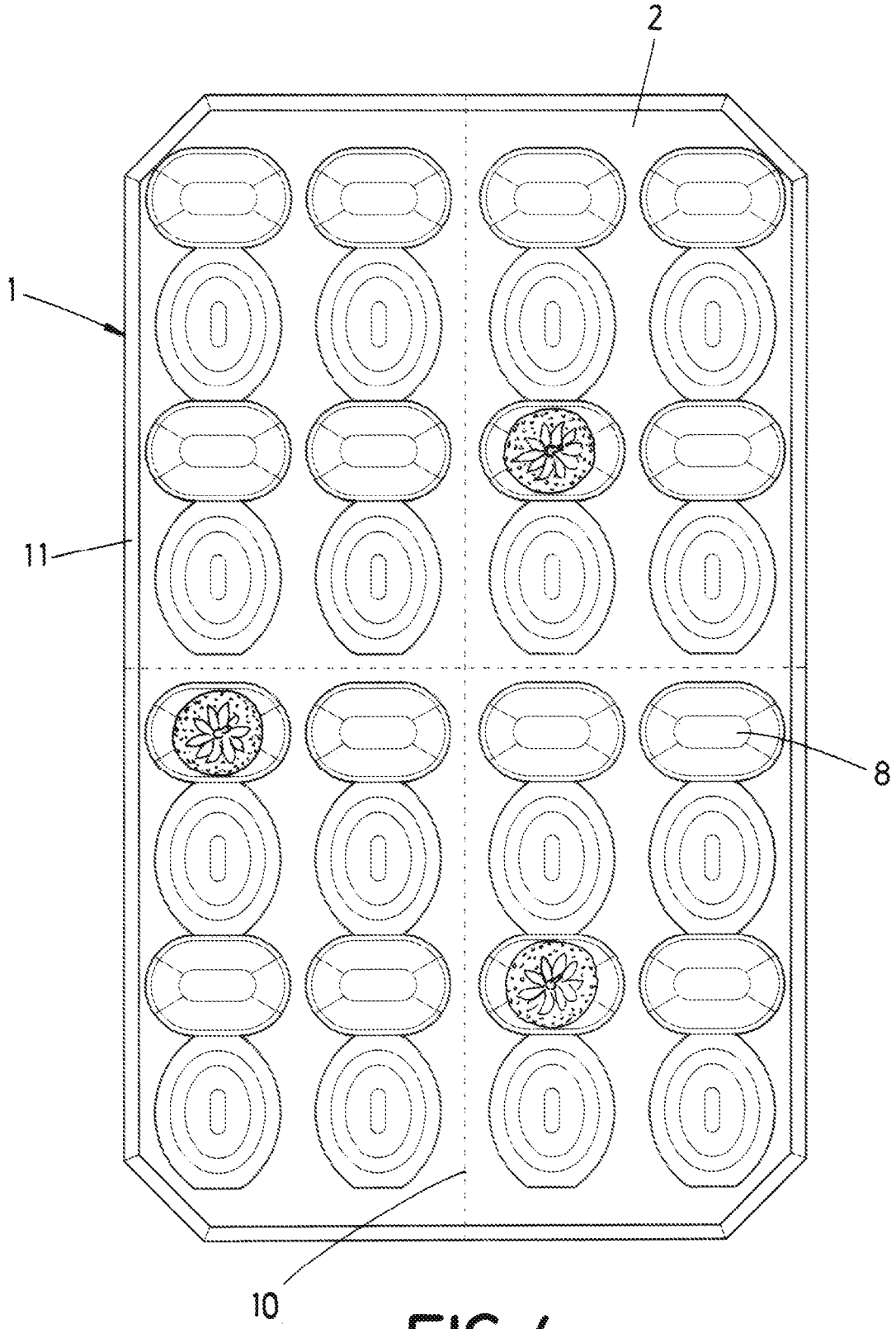
FIG. 4 portrays a plan view of the lower side of the tray.
Figure 5:
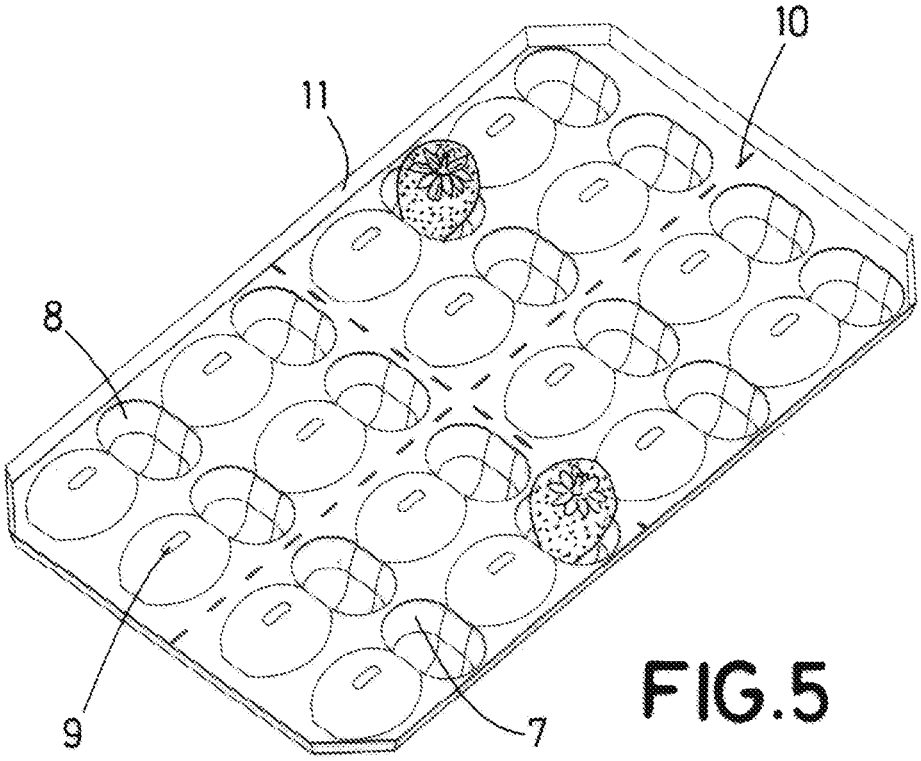
FIG. 5 portrays a perspective view of the lower side of the tray.

In the preferred embodiment described herein, said internal side (7) is defined by progressively decreasing horizontal sections of an oval configuration, giving rise to a niche (8), geometrically shaped so as to enable the accommodation of the strawberry in a vertical position, leaving the sepal in view, as portrayed in FIGS. 4 and 5.

The external side (6) of the protuberances gives rise to a supporting surface which enables the punnet to be slightly tilted, with the strawberries contained within the cavities (3) in a horizontal position, in such a way that they are in full view of the consumer without the strawberry slipping and falling from the cavity (3) due to the effect of gravity.

Figure 6:
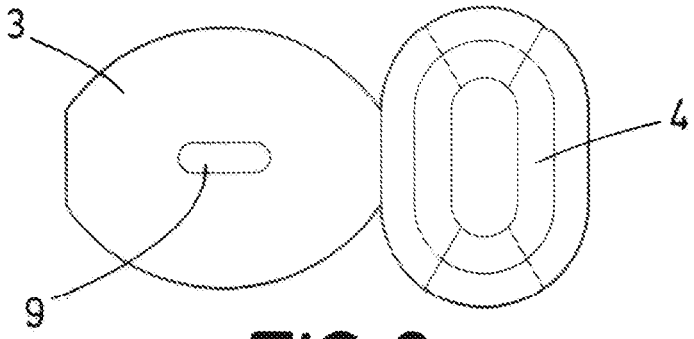
FIG. 6 portrays a plan view of a detail of the upper side of the tray, wherein the format of a cavity and its corresponding protuberance may be viewed.
Figure 7:
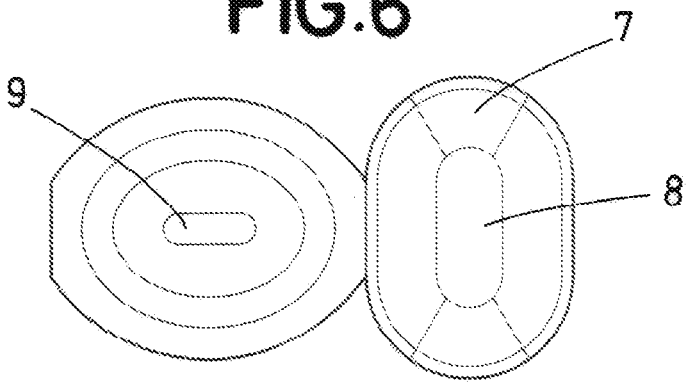
FIG. 7 portrays a plan view of a detail of the lower side of the tray, wherein the niche formed in the hollow interior of the protuberance may be viewed.

The option that each of the cavities (3) may feature a perforation (9) at its base, as portrayed in FIGS. 6 and 7, is considered, in order to enable uniform refrigeration of the strawberries and the drainage of accumulated fluids, thus avoiding problems in the preservation of the fruit.

It is further foreseen that the sheet (1) may feature on its flat surface (2) a plurality of tear lines (10), in order to separate, by means of simple traction, the sheet (1) and therefore the punnet formed by the same into as many as 4 equal parts, thus giving rise to as many as 4 punnets of smaller dimensions.

Finally, consideration has also been given to the additional option that the perimetral edge of the sheet (1) may incorporate a reversible extension (11). Said extension (11) facilitates the fitting of the punnet into the box for its transport and prevents contact between the fruit and said box, and furthermore, after removal of the punnet from the box, enables its placement both at the sales outlet and in the domestic environment.

Both the geometry and the dimensions, and therefore the number, of the cavities (3) and their corresponding protuberances (4) in the punnet are variable, in accordance with the size of the strawberries which they are destined to contain. In addition to the preferred embodiment portrayed in FIGS. 1 to 7, wherein there are 16 cavities (3) and protuberances (4) and their corresponding niches (8), to accommodate 16 large-sized strawberry units, options featuring 24, 32, 44, 60 and 76 cavities (3) are considered, for the accommodation of strawberries of a smaller size.

In accordance with a preferred embodiment, the rectangular sheet (1) of the punnet comprises dimensions of 22.8×38.5 centimetres, enabling its fitting into the boxes habitually employed for the transport of fruit, these being stackable on euro-pallets. The tear lines (10) enable the division of the sheet (1) into as many as 4 equal parts, giving rise to as many as 4 punnets.

The sheet (1) of the punnet is made preferably from a material to be selected between plastic, pressed cellulose and paper.

The invention claimed is:

1. A punnet for strawberries, intended to be fitted in the interior of a box for its storage and transport, configured by a sheet which comprises:

a flat surface, a number of cavities which extend inferiorly from the flat surface to accommodate the strawberries in a horizontal position, and a number of protuberances located in correspondence with each of the cavities and which extend superiorly with regard to the flat surface, wherein the cavities and the protuberances are uniformly distributed throughout the flat surface, wherein the cavities present a curved configuration delimited by an essentially elliptic perimetral edge featuring a larger axis and a smaller axis, which enable the accommodation of the strawberry in the first position, wherein the first position is a horizontal position and the protuberances extend from at least one of the extremities of the larger axis, incorporating an outstanding sector, featuring an external side and an internal side, opposite to the external side, and a niche delimited by the internal side of said outstanding sector, to accommodate the strawberries in a vertical position; and the internal side of the outstanding sector which delimits the niche is defined by progressively decreasing horizontal sections of an oval configuration, enabling the accommodation of the strawberry in a vertical position.

2. A punnet for strawberries, as claimed in claim 1, wherein each of the cavities features a perforation performed at its base, to facilitate the refrigeration of the strawberry contained therein.

3. A punnet for strawberries, as claimed in claim 1, wherein the sheet features a plurality of tear lines to enable the division by traction of said sheet, and the punnet configured by the same, into a plurality of punnets of smaller dimensions.

4. A punnet for strawberries, as claimed in claim 1, wherein the perimetral edge of the sheet further incorporates a reversible extension to facilitate the fitting of the punnet in the box.

5. A punnet for strawberries, as claimed in claim 1, wherein the sheet is of an essentially rectangular shape.

6. A punnet for strawberries, as claimed in claim 1, wherein the sheet is made from a material selected between plastic, pressed cellulose and paper.

* * * * *